US011306891B1

(12) United States Patent
Qiu et al.

(10) Patent No.: US 11,306,891 B1
(45) Date of Patent: Apr. 19, 2022

(54) VEHICLE LIGHT OPTICAL ELEMENT, VEHICLE LIGHT MODULE, VEHICLE HEADLIGHT AND VEHICLE

(71) Applicant: HASCO VISION TECHNOLOGY CO., LTD., Shanghai (CN)

(72) Inventors: Zhiping Qiu, Shanghai (CN); Dapan Zhang, Shanghai (CN); He Zhu, Shanghai (CN)

(73) Assignee: HASCO VISION TECHNOLOGY CO., LTD., Shanghai (CN)

( * ) Notice: Subject to any disclaimer, the term of this patent is extended or adjusted under 35 U.S.C. 154(b) by 0 days.

(21) Appl. No.: 17/261,308

(22) PCT Filed: Sep. 6, 2019

(86) PCT No.: PCT/CN2019/104606
§ 371 (c)(1),
(2) Date: Jan. 19, 2021

(87) PCT Pub. No.: WO2020/244080
PCT Pub. Date: Dec. 10, 2020

(30) Foreign Application Priority Data

Jun. 5, 2019 (CN) ..... 201910488336
Jun. 5, 2019 (CN) ..... 201920859938
(Continued)

(51) Int. Cl.
*F21S 41/265* (2018.01)
*F21S 41/37* (2018.01)

(52) U.S. Cl.
CPC ..... *F21S 41/265* (2018.01); *F21S 41/37* (2018.01)

(58) Field of Classification Search
CPC ..... F21S 41/151; F21S 41/153; F21S 41/265; F21S 41/27; F21S 41/275
See application file for complete search history.

(56) References Cited

U.S. PATENT DOCUMENTS 10,139,646 B2 * 11/2018 Gromfeld ..... G02B 27/30
10,228,108 B2 * 3/2019 Courcier ..... F21S 41/265
(Continued)

FOREIGN PATENT DOCUMENTS

CN 103912833 A 7/2014
CN 105423209 A 3/2016
(Continued)

*Primary Examiner* — Matthew J. Peerce
(74) *Attorney, Agent, or Firm* — Volpe Koenig

(57) ABSTRACT

An vehicle light optical element (1) related to the technical field of vehicle lighting. The optical vehicle light element (1) comprises a light incident portion (10), a light transmission portion (11), and a light emitting portion. Two ends on the light transmission portion (11) in a light emitting direction are respectively a light incident end and a light emitting end. The light incident portion (10) comprises at least one light incident structure (13) provided at the light incident end of the light transmission portion (11) and corresponding to a light source (20). The light emitting portion comprises a light emitting surface (12) protruding from the light emitting end of the light transmission portion (11) towards the light emitting direction. A cross-sectional area of the light transmission portion (11) gradually increases from the light incident end to the light emitting end. The light incident portion (10) and the light emitting portion of the vehicle light optical element (1) are provided on the same optical structure. Therefore, no optical path needs to be built, and an assembly relationship is simple, thereby simplifying the structure of the vehicle light optical element (1), and improving optical system precision of the vehicle light optical element (1).

14 Claims, 5 Drawing Sheets

(30) Foreign Application Priority Data

Aug. 22, 2019 (CN) ..... 201910780791
Aug. 22, 2019 (CN) ..... 201921377931

(56) References Cited

U.S. PATENT DOCUMENTS

| | | | | |
|---|---|---|---|---|
| 10,690,307 | B2 * | 6/2020 | Gromfeld | F21S 41/663 |
| 10,697,601 | B2 * | 6/2020 | Courcier | F21S 41/143 |
| 10,876,694 | B2 * | 12/2020 | Courcier | F21S 41/143 |
| 10,962,190 | B2 * | 3/2021 | Matsuda | F21S 41/322 |

FOREIGN PATENT DOCUMENTS

| | | | |
|---|---|---|---|
| CN | 107664295 | A | 2/2018 |
| CN | 108613112 | A | 10/2018 |
| CN | 208074871 | U | 11/2018 |
| CN | 109539163 | A | 3/2019 |
| CN | 109611780 | A | 4/2019 |
| CN | 210740255 | U | 6/2020 |
| WO | 2017059945 | A1 | 4/2017 |

* cited by examiner

VEHICLE LIGHT OPTICAL ELEMENT, VEHICLE LIGHT MODULE, VEHICLE HEADLIGHT AND VEHICLE

CROSS REFERENCE TO RELATED APPLICATIONS

This application is a 35 USC § 371 national stage of international application No. PCT/CN2019/104606, which is entitled "VEHICLE LIGHT OPTICAL ELEMENT, VEHICLE LIGHT MODULE, VEHICLE HEADLIGHT AND VEHICLE," was filed Sep. 6, 2019, and claims priority to Chinese Application Nos. 201910488336.X, filed on Jun. 5, 2019; 201920859938.7, filed on Jun. 5, 2019; 201910780791.7, filed on Aug. 22, 2019; and 201921377931.8, filed on Aug. 22, 2019 all of which are incorporated herein by reference as if fully set forth.

FIELD OF THE INVENTION

The present disclosure relates to the technical field of vehicle lighting, in particular to a vehicle light optical element, a vehicle light module, a vehicle headlight and a vehicle.

BACKGROUND OF THE INVENTION

A vehicle headlight is usually provided with a vehicle light module internally. The vehicle light module refers to a device or a unit which can be used independently or in combination for achieving different lighting functions of a vehicle, for example, a Matrix headlight module, namely a vehicle light module capable of subdividing a high beam lighting area into a plurality of lighting areas, achieves an ADB self-adaptive high beam function, can adaptively change a high beam light pattern according to road conditions, and shields targets in front of the vehicle for avoiding dazzling other roads users, and thus the driving safety is improved.

An existing vehicle light module is usually provided with a primary optical element (such as a reflector and a light guide) and a secondary optical element (such as a lens). Through the cooperation of the primary optical element and the secondary optical element, high beam and low beam are switched. Patent application CN107664295A discloses a vehicle optical module which is applicable to matrix headlights and is provided with a collimating lens as a primary optical element and a secondary lens as a secondary optical element. Patent application CN109611780A discloses a motor vehicle high beam lighting module which is applicable to matrix headlights and comprises a circuit board provided with a condenser, the condenser is located in an accommodation cavity formed by the circuit board, a lens holder and a lens, wherein the condenser is used as the primary optical element of the module, and the lens is used as the secondary optical element of the module.

Due to the large number of components in the existing vehicle light module, the assembling relationship of the vehicle light module is complicated, and due to influences of the manufacturing precision of the components of the primary optical element and the secondary optical element and the assembly assembling precision, the existing vehicle light module has the problems of complicated assembling, difficult dimming, large precision errors of an optical system, and the like.

SUMMARY OF THE INVENTION

The present disclosure aims to solve the problems of complicated assembling, difficult dimming and large precision errors of an optical system of an existing vehicle light module, and provides a vehicle light optical element applicable to a vehicle light module.

In order to achieve the above object, in the first aspect, the present disclosure provides a vehicle light optical element, and the vehicle light optical element includes a light incident portion, a light transmission portion and a light emergent portion;

a rear end and a front end of the light transmission portion in a light emergent direction are used as a light incident end and a light emergent end, respectively;

the light incident portion includes at least one light incident structure which is arranged at the light incident end of the light transmission portion and corresponds to a light source;

the light emergent portion includes a light emergent surface arranged protruding from the light emergent end of the light transmission portion in the light emergent direction; and a cross section area of the light transmission portion gradually increases from the light incident end to the light emergent end.

Preferably, the light incident structures are arranged in a matrix at the light incident end of the light transmission portion; and the light incident structures are arranged in at least one row on an end face of the light incident end of the light transmission portion.

Preferably, the light incident structures are cones protruding from the light incident end of the light transmission portion towards the light sources;

a top of each of the cones corresponds to the corresponding light source; and each of the light incident structures and the light emergent surface of the light emergent portion form a biconvex lens structure in the light emergent direction.

Preferably, the light emergent surface of the light emergent portion is of a curved surface structure formed by successively splicing a plurality of convex lens surfaces.

Preferably, a length of a cross section of the light transmission portion in a lateral direction and/or in a longitudinal direction gradually increases from the light incident end to the light emergent end;

the light transmission portion includes a side wall connecting the light incident end with the light emergent end of the light transmission portion;

the side wall is a spliced surface formed by splicing a plurality of side surfaces, and the side surfaces are flat surfaces or curved surfaces; and each of the side surfaces is parallel to a central axis of the light transmission portion or forms an angle with the central axis of the light transmission portion.

Preferably, at least one side surface of the light transmission portion is provided with light eliminating wrinkles, and the light eliminating wrinkles are grains or light eliminating teeth.

In the second aspect, the present disclosure provides a vehicle light module. The vehicle light module includes a radiator, a heat dissipation bracket, a light source circuit board and the above vehicle light optical element;

the light source circuit board is arranged behind the light incident portion of the vehicle light optical element, and the light sources on the light source circuit board correspond to the light incident structures of the vehicle light optical element in a one-to-one mode;

each said light source on the light source circuit board can be independently controlled to be turned on or off; and the vehicle light optical element is used for dividing a high beam lighting area into a plurality of lighting units, the number of the lighting units is equal to that of the light sources, and the brightness of each lighting unit is independently controlled by the corresponding light source.

Preferably, the light sources are LED light sources or laser light sources.

In the third aspect, the present disclosure provides a vehicle headlight, the vehicle headlight includes a headlight body and at least one of the above vehicle light modules mounted in the headlight body; and when a plurality of the vehicle light modules are mounted, the plurality of the vehicle light modules are integrally arranged or dispersedly arranged in the headlight body.

In the fourth aspect, the present disclosure provides a vehicle provided with the above vehicle headlight.

According to the vehicle light optical element provided by the above technical solutions, since the light incident portion and the light emergent portion are arranged on a same optical structure, an optical path does not need to be built, other unnecessary supporting devices do not need to be arranged, the assembling relationship is simple, the part manufacturing precision and the precision of the optical system of the vehicle light optical element are improved, meanwhile, and the size of the vehicle light optical element can be adaptively reduced while meeting light distribution requirements so as to be beneficial to integrated research.

BRIEF DESCRIPTION OF THE SYMBOLS

Figure 1:
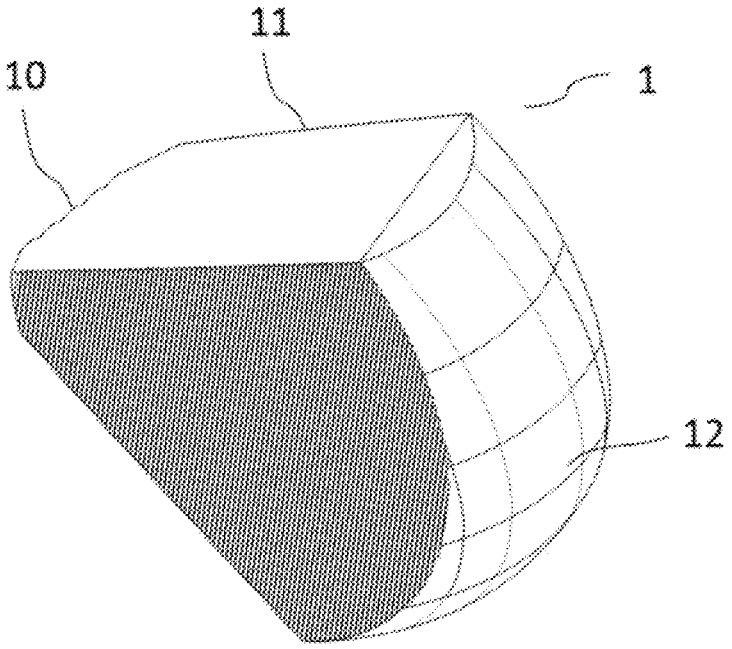
FIG. 1 is a stereoscopic structural schematic diagram of a vehicle light optical element in a first perspective.

Vehicle light optical element 1
Vehicle light module 2
Vehicle headlight 3
Light incident portion 10
Light transmission portion 11
Light emergent surface 12
Light incident structure 13
Side surface 14
Light source 20
Headlight body 30

DETAILED DESCRIPTION OF THE EMBODIMENTS

Hereinafter, specific embodiments of the present disclosure are described in detail with reference to the accompanying drawings. It should be understood that the specific embodiments described herein are only provided to describe and explain the present disclosure, but are not intended to limit the present disclosure.

Existing vehicle light modules are affected by the part precision and mounting position precision of the primary optical elements and the secondary optical elements, so that optical systems of the existing vehicle light modules are difficult to adjust and large in system precision errors, and in order to solve the above technical problems, the first embodiment of the present disclosure provides a vehicle light optical element. The vehicle light optical element is used in a vehicle light module.

For the convenience of description, terms "front" and "rear" described below correspond to a "front" direction and a "rear" direction of a vehicle during normal running, and lighting areas of a headlight are in the front direction. "Up" and "down" directions are the same as "up" and "down" directions of the optical element in FIG. 3, namely, the "up" and "down" directions of the headlight during normal running of the vehicle; "front", "rear", "left" and "right" correspond to "front", "rear", "left" and "right" directions in FIG. 5 respectively, namely front, rear, left and right directions of the headlight during normal running of the vehicle, and the light emergent direction of the headlight is from "rear" to "front".

Referring to FIGS. 1-8, the first embodiment of the present disclosure provides a vehicle light optical element 1. The vehicle light optical element 1 is integrally formed, and provided with a light incident portion 10, a light transmission portion 11 and a light emergent portion. A rear end and a front end of the light transmission portion 11 in a light emergent direction are used as a light incident end and a light emergent end respectively.

Figure 2:
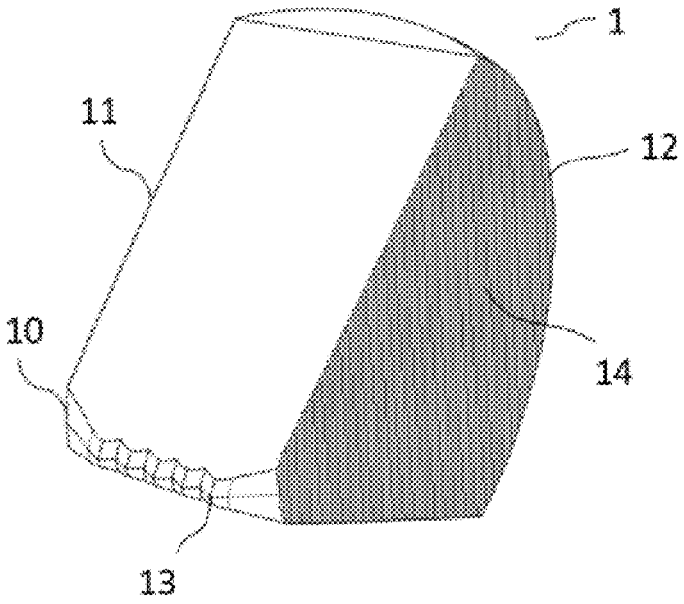
FIG. 2 is a stereoscopic structural schematic diagram of the vehicle light optical element in a second perspective.

As shown in FIG. 2, the light incident portion 10 includes at least one light incident structure 13 which is arranged at the light incident end of the light transmission portion 11 and corresponds to light sources. The light incident portion 10 is used for introducing light emitted by the light sources into the light transmission portion 11 through the light incident structures 13. The light transmission portion 11 is used for collecting incident light introduced through the light incident portion 10 and reflected light reflected through a side wall of the light transmission portion 11 and transmitting collected light to the light emergent portion. The light emergent portion includes a light emergent surface 12 protruding from the light emergent end of the light transmission portion 11 in the light emergent direction, and the light emergent portion refracts light through the light emergent surface 12 to form high beam.

Figure 3:
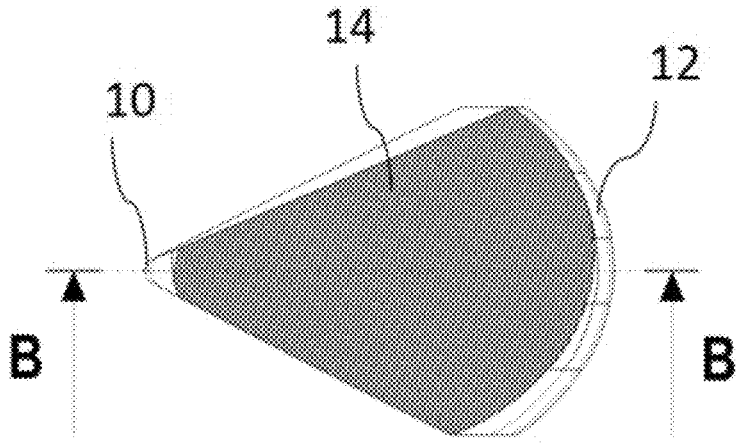
FIG. 3 is a side view of the vehicle light optical element.
Figure 4:
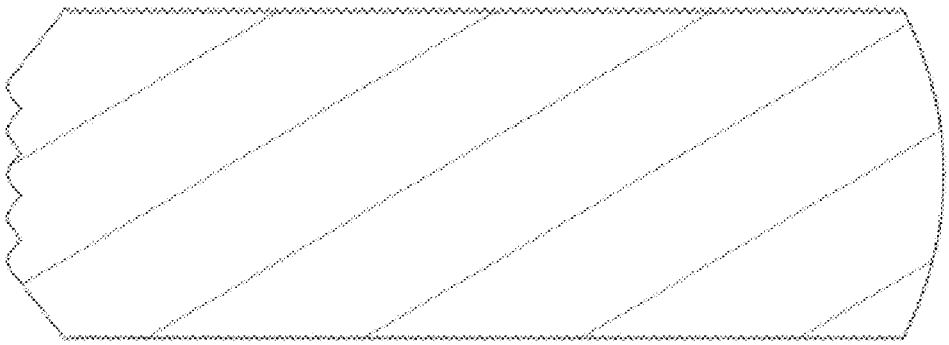
FIG. 4 is a cross section schematic diagram of the vehicle light optical element shown in FIG. 3 along the line B-B.
Figure 5:
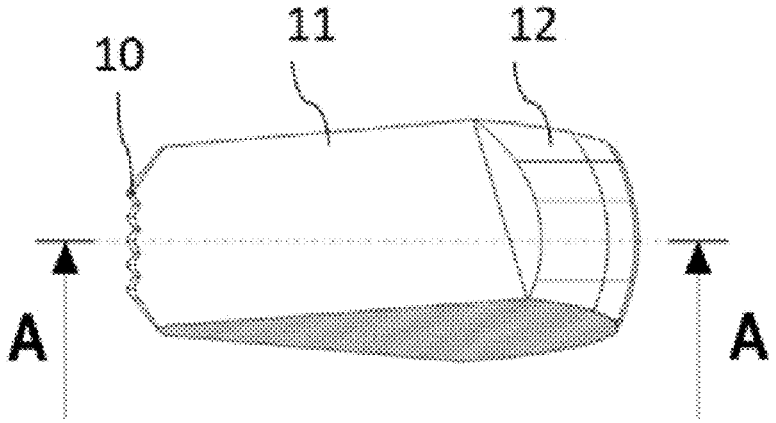
FIG. 5 is a top view of the vehicle light optical element.
Figure 6:
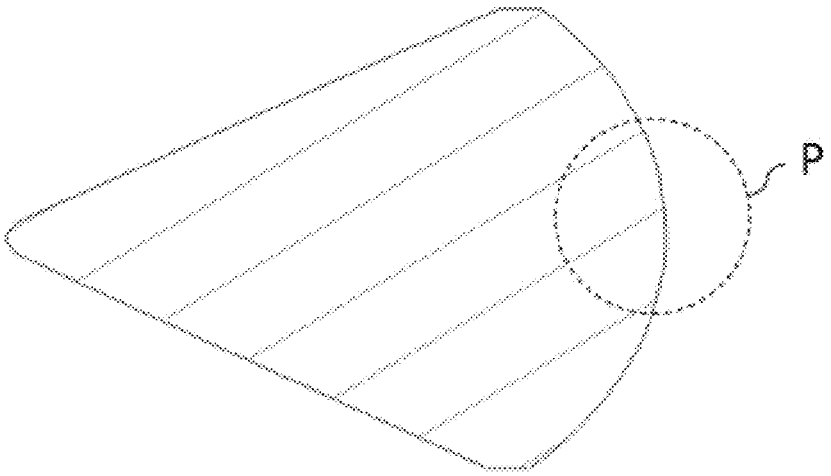
FIG. 6 is a cross section schematic diagram of the vehicle light optical element shown in FIG. 5 along the line A-A.

According to a preferred embodiment of the present disclosure, the vehicle light optical element 1 is provided with a central axis, and the central axis is a straight line extending in the light emergent direction and passing through the vertex of the light emergent surface, wherein the vertex of the light emergent surface is a tangent point of the light emergent surface 12 and a vertical plane in an up-down direction, as shown in FIG. 3. In a cross section of the light transmission portion 11 from the light incident end to the light emergent end, the length in the lateral direction and/or the length in the longitudinal direction gradually increases, that is, the length in the left-right direction shown in FIG. 5 and/or the length in the up-down direction shown in FIG. 3 gradually increases, so that the cross section area of the light transmission portion 11 gradually increases from the light incident end to the light emergent end, and the cross section is perpendicular to the central axis of the vehicle light optical element 1. Exemplarily, as shown in FIG. 5 and FIG. 6, the cross section in the A-A direction of the vehicle light optical element 1 is in a fan shape expanding from the light incident portion 10 to the light emergent surface 12, that is, the length of the cross section of the light transmission portion 11 in the up-down direction gradually increases from the light incident end to the light emergent end. Therefore, the vehicle light optical element 1 is externally of a cone structure with a small rear end and a large front end. The rear end of the cone structure is arranged as the light incident portion 10, and a curved surface protruding outwards at the front end of the cone structure is used as the light emergent surface 12, thus, light introduced by the light incident portion 10 can be better collected by the light transmission portion 11 and projected onto the light emergent surface 12, and meanwhile, the size of the vehicle light optical element 1 can be adaptively reduced on the premise that the light emergent requirement of the light emergent surface 12 is met.

In the present disclosure, the vehicle light optical element 1 adopts an optical material with good light guiding performance. Optionally, the vehicle light optical element 1 is made of transparent silica gel or glass or optical plastic such as PMMA or PC.

According to a preferred embodiment of the present disclosure, the light incident structures 13 are arranged in a matrix at the light incident end of the light transmission portion 11, and the light incident structures 13 are arranged in at least one row on the end face of the light incident end of the light transmission portion 11. Optionally, the light incident structures 13 are arranged in one row or two rows or more rows at the light incident end of the light transmission portion 11.

According to a preferred embodiment of the present disclosure, the light incident structures 13 are cones protruding from the light incident end of the light transmission portion 11 towards the light sources, and the top of each cone corresponds to the corresponding light source. As shown in FIG. 2, a row of five light incident structures 13 is arranged at the light incident end of the light transmission portion 11, the light incident structures 13 are rectangular pyramids protruding from the light incident end of the light transmission portion 11 towards the light sources, the tops of the rectangular pyramids protrude towards the light sources, and side surfaces of the rectangular pyramids may be flat or curved. Bottom edges of every two adjacent rectangular pyramids are connected or every two adjacent rectangular pyramids are spaced. In the embodiment, tops of all the rectangular pyramids correspond to mounting positions of the light sources, light emitting centers of the light sources correspond to the tops of the rectangular pyramids, and the light sources are preferably arranged at focal points of the light incident structures 13. It should be noted that each light incident structure 13 and the light emergent surface 12 of the light emergent portion form a biconvex lens structure in the light emergent direction, and light emitted by the light sources is collected by the light transmission portion 11, collimated by the light emergent surface 12 and then projected forwards to form a corresponding light pattern in the lighting area. It should be noted that the size of the vehicle light optical element 1 is related to the number of to-be-mounted light sources, and the size of the vehicle light optical element 1 is adaptively reduced as the number of light sources decreases. Optionally, in the present disclosure, the light incident structures 13 of the light incident portion 10 may be arranged as a planar structure, or light condensing bowls formed by sinking towards the light emergent direction in the light incident portion 10 may be used as the light incident structures 13.

Figure 7:
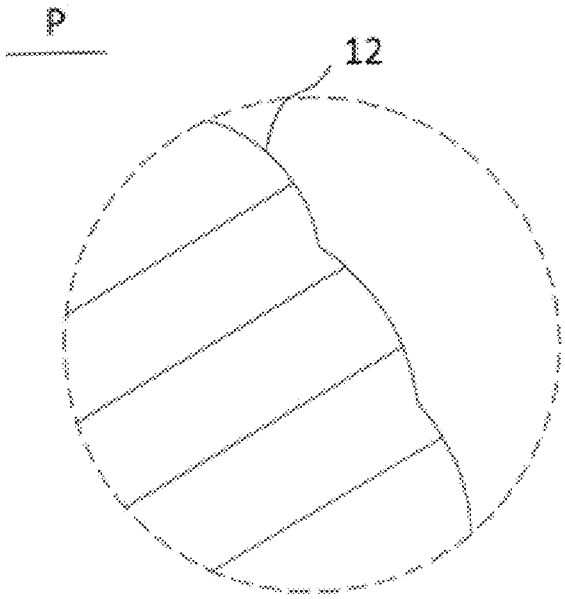
FIG. 7 is an enlarged schematic view of the portion P shown in FIG. 6.
Figure 8:
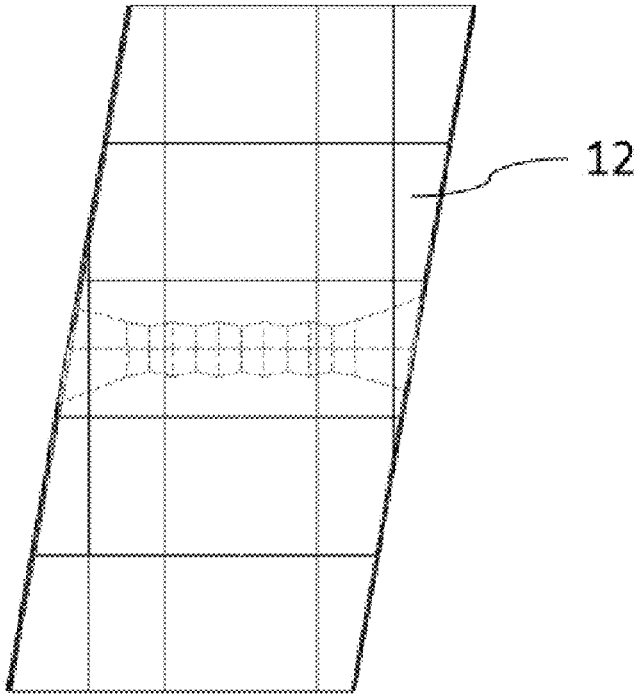
FIG. 8 is a front view of the vehicle light optical element.

According to a preferred embodiment of the present disclosure, the light emergent surface 12 of the light emergent portion may be a complete curved surface, or as shown in FIG. 7 and FIG. 8, the light emergent surface 12 is of a curved surface structure formed by successively splicing a plurality of convex lens surfaces, and the light emergent surface 12 is a latticed curved surface as a whole. In the embodiment, the light emergent surface 12 of the light emergent portion can be regarded as a continuous and smooth curved surface formed by connecting a plurality of smooth convex lens curved surfaces by curvature. Each convex lens surface can be used for diverging light so as to enlarge the lighting area.

In the case of meeting the light emergent requirements, the boundary of the light emergent surface 12 can be trimmed to be of any proper shape according to customer requirements. For example, as shown in FIG. 8, the boundary of the light emergent surface 12 is in a parallelogram shape.

In the present disclosure, the light transmission portion 11 includes a side wall used for connecting the light incident portion 10 with the light emergent surface 12. According to a preferred embodiment of the present disclosure, the side wall of the light transmission portion 11 is a continuous curved surface in a circumferential direction, and light eliminating wrinkles are arranged on the continuous surface. Alternatively, according to another preferred embodiment of the present disclosure, the side wall of the light transmission portion 11 is formed by splicing a plurality of side surfaces 14, and each side surface 14 is parallel to the central axis of the light transmission portion 11 or forms an angle with the central axis of the light transmission portion 11. In the embodiment, at least one side surface 14 of the light transmission portion 11 is provided with light eliminating wrinkles.

Preferably, the light eliminating wrinkles are grains or light eliminating teeth, so that the surface of the side wall of the light transmission portion 11 is rough or uneven, therefore, light directly emitted from the side wall of the light transmission portion 11 or stray light formed by reflection through the side wall of the light transmission portion 11 is reduced, and the light condensing capability of the light transmission portion 11 is improved. Exemplarily, the light eliminating teeth are a plurality of grooves recessed inwards from surfaces of the side surfaces of the light transmission portion 11.

According to the vehicle light optical element provided by the embodiment of the present disclosure, in the first aspect, since the light incident portion is smaller than the light emergent portion, light introduced from the light incident portion can be well collected by the light transmission portion and projected to the light emergent portion; in the second aspect, since the light incident portion and the light emergent portion are arranged on the same optical structure, an optical path does not need to be built, other unnecessary supporting devices do not need to be mounted, and the structure of the vehicle light optical element is simplified, so that the manufacturing precision of the vehicle light optical element is high; and in the third aspect, the size of the vehicle light optical element can be adaptively reduced while meeting the light distribution requirement so as to be beneficial to integrated research.

Figure 9:
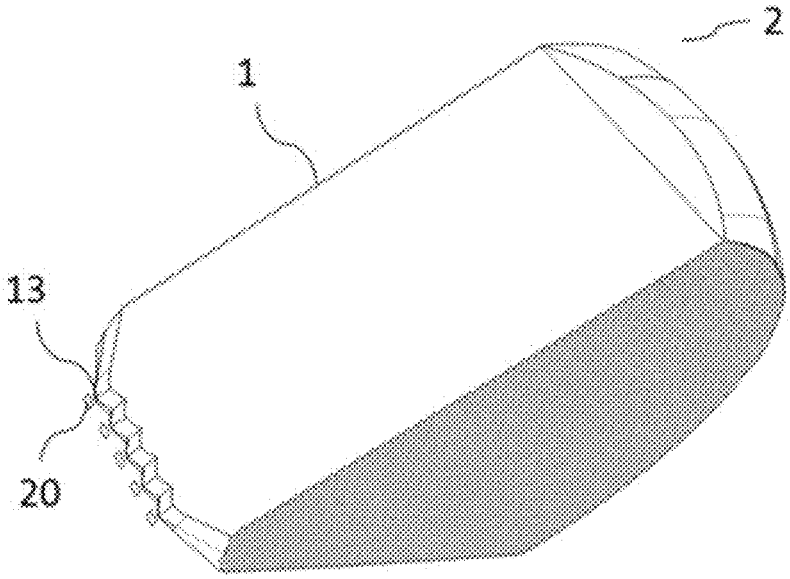
FIG. 9 is a structural schematic diagram of a vehicle light module.
Figure 10:
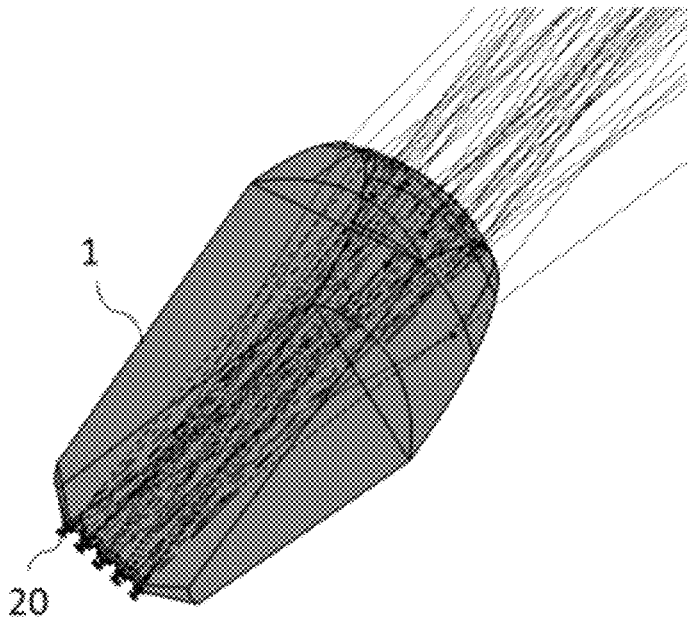
FIG. 10 is a schematic diagram of the light directions in the vehicle light module shown in FIG. 9.

As shown in FIG. 9, the second embodiment of the present disclosure provides a vehicle light module 2. The vehicle light module 2 includes a light source circuit board and the above vehicle light optical element 1. The light source circuit board is arranged behind the light incident portion 10 of the vehicle light optical element 1, and light sources 20 on the light source circuit board correspond to the light incident structures 13 of the vehicle light optical element 1 in a one-to-one mode. The vehicle light module 2 is further provided with structures (not shown in FIG. 9) such as a radiator or a heat dissipation bracket for providing support and heat dissipation functions for the light source circuit board and the vehicle light optical element 1. As shown in FIG. 10, after light emitted by the light sources 20 is emitted into the above vehicle light optical element 1 through the light incident portion 10, the light is collected by the light transmission portion 11 and transmitted to the light emergent portion, and collimated by the light emergent surface 12 of the light emergent portion, then the collimated light is emitted forwards and projected to form a Matrix light pattern corresponding to the number of the light sources 20. According to a preferred embodiment of the present disclosure, each light source 20 on the light source circuit board can be independently controlled to be turned on or off. The vehicle light optical element 1 is used for dividing a high beam lighting area into a plurality of lighting units with the number being equal to the number of the light sources 20, and the brightness of each lighting unit is controlled independently by the corresponding light source 20.

In the embodiment, since the size of the vehicle light optical element 1 adaptively decreases as the number of light sources 20 decreases, the size of the light emergent surface 12 of the vehicle light optical element 1 also decreases accordingly, for example, in the vehicle light optical element 1 provided by the embodiment, the opening size of the light emergent surface 12 is about 20 mm high and about 10 mm wide, and is much smaller than the opening size of the lens of a current Matrix headlight module, and thus the vehicle light optical element 1 can adapt to more varied headlight images. In addition, the light incident structures 13 may also be arranged in multiple rows in the up-down direction along the light transmission portion 11, when each light incident structure 13 is correspondingly provided with one light source 20, the lighting area of the vehicle light module 2 can form a Matrix light pattern in multiple rows, and Fig. only shows a single-row matrix light pattern formed by five light incident structures 13 and the light sources 20 of the five light incident structures 13.

In the embodiment, the light sources 20 are LED light sources or laser light sources. In the embodiment, each vehicle light module is provided with light sources, a vehicle light optical element and necessary supporting devices only, so the vehicle light module is simple and compact in structure, low in cost and simple in assembling relationship, and the external dimension of the vehicle light module can also be adaptively reduced. Meanwhile, under the condition that the part manufacturing precision of the vehicle light optical element meets the requirements, the precision of an optical system of the vehicle light module is only related to the assembling precision between the vehicle light optical element and the light sources, thus, the dimming difficulty is low, and the precision errors of the optical system of the vehicle light module are small.

Figure 11:
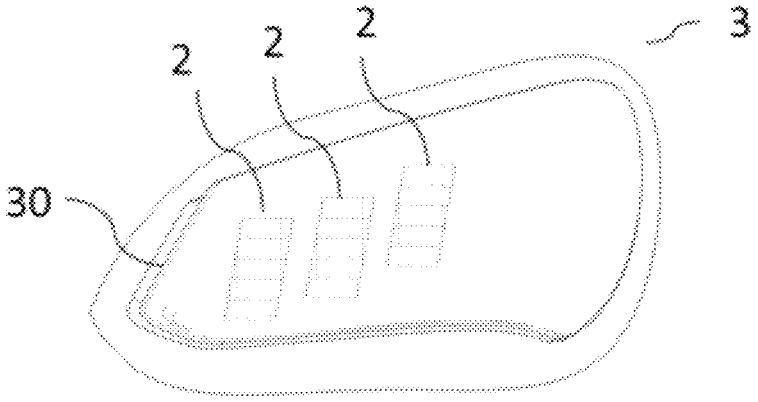
FIG. 11 is a structural schematic diagram of a vehicle headlight.

The third embodiment of the present disclosure provides a vehicle headlight 3. The vehicle headlight 3 is mounted on a head of a vehicle and is used for lighting a driving area in front of the vehicle so as to improve visibility of the road conditions for a driver. As shown in FIG. 11, the vehicle headlight 3 includes a headlight body 30 and at least one vehicle light module 2 mounted in the headlight body. When a plurality of vehicle light modules 2 are mounted in the vehicle headlight 3, the plurality of vehicle light modules 2 may be integrally or dispersedly arranged in the headlight body 30. As shown in FIG. 11, three vehicle light modules 2 are dispersedly arranged in the headlight body 30 of the vehicle headlight 3 and jointly form a Matrix headlight.

Figure 12:
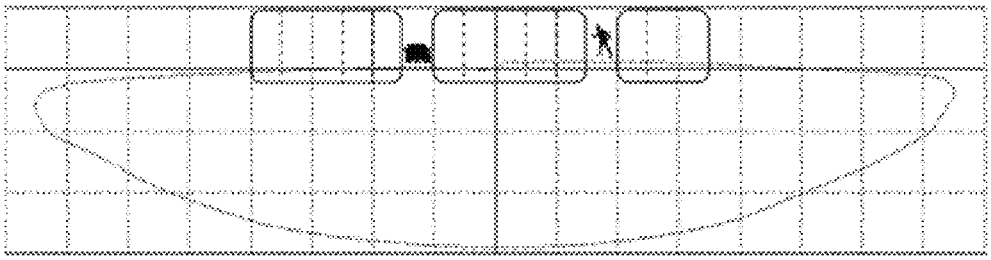
FIG. 12 is a schematic diagram of the light pattern of the vehicle headlight shown in FIG. 11.

Exemplarily, five LED light sources are arranged in each vehicle light module 2, the vehicle headlight 3 provided with three above vehicle light modules 2 is provided with 15 LED light sources in total, namely 15 lighting pixels, the high beam lighting area of the vehicle headlight 3 is divided into 15 lighting units, and the brightness of each lighting unit is controlled independently by the corresponding LED light source. As shown in FIG. 12, when obstacles such as other vehicles or pedestrians appear on the driving route of the vehicle, by adjusting the high beam light pattern of the vehicle headlight 3, the LED light source corresponding to the lighting unit where the obstacles are located is turned off, so that the area where the lighting unit is located is dimmed, other road users are prevented from being dazzled, and thus the driving safety is improved. Meanwhile, in order to ensure the optical uniformity of a whole high beam field area, the adjacent lighting units partially overlap at the boundary positions so as to avoid excessively sharp field boundaries.

The fourth embodiment of the present disclosure provides a vehicle provided with the above vehicle headlight 3.

The preferred embodiments of the present disclosure are described in detail above, but the present disclosure is not limited thereto. Within the scope of the technical concept of the present disclosure, a variety of simple modifications can be made to the technical solutions of the present disclosure, including the combination of various technical features in any other proper mode, the simple modifications and combinations should also be regarded as the content disclosed by the present disclosure and all fall into the protection scope of the present disclosure.

The invention claimed is:

1. A vehicle light optical element, including a light incident portion, a light transmission portion and a light emergent portion; wherein a rear end and a front end of the light transmission portion in a light emergent direction are used as a light incident end and a light emergent end, respectively;

the light incident portion includes at least one light incident structure which is arranged at the light incident end of the light transmission portion and corresponds to a light source;

the light emergent portion includes a light emergent surface arranged protruding from the light emergent end of the light transmission portion in the light emergent direction; and a cross section area of the light transmission portion from the light incident end to the light emergent end gradually increases;

the light incident structures are arranged in a matrix at the light incident end of the light transmission portion; and the light incident structures are arranged in at least one row on an end face of the light incident end of the light transmission portion;

the light incident structures are cones protruding from the light incident end of the light transmission portion towards the light sources;

a top of each of the cones corresponds to the corresponding light source; and each of the light incident structures and the light emergent surface form a biconvex lens structure in the light emergent direction.

2. The vehicle light optical element according to claim 1, wherein the light emergent surface of the light emergent portion is of a curved surface structure formed by successively splicing a plurality of convex lens surfaces.

3. The vehicle light optical element according to claim 1, wherein a length of a cross section of the light transmission portion in a lateral direction and/or in a longitudinal direction gradually increases from the light incident end to the light emergent end;

the light transmission portion includes a side wall connecting the light incident end with the light emergent end of the light transmission portion;

the side wall is a spliced surface formed by splicing a plurality of side surfaces, and the side surfaces are flat surfaces or curved surfaces; and wherein each of the side surfaces is parallel to a central axis of the light transmission portion or forms an angle with the central axis of the light transmission portion.

4. The vehicle light optical element according to claim 3, wherein at least one side surface of the light transmission portion is provided with light eliminating wrinkles and the light eliminating wrinkles are grains or light eliminating teeth.

5. A vehicle light module, including a radiator, a heat dissipation bracket, a light source circuit board and the vehicle light optical element according to claim 1; wherein the light source circuit board is arranged behind the light incident portion of the vehicle light optical element, and the light sources on the light source circuit board correspond to the light incident structures of the vehicle light optical element in a one-to-one mode;

each said light source on the light source circuit board is independently controlled to be turned on or off, and the vehicle light optical element is used for dividing a high beam lighting area into a plurality of lighting units, the number of the lighting units is equal to the number of the light sources, and the brightness of each lighting unit is independently controlled by the corresponding light source.

6. The vehicle light module according to claim 5, wherein the light sources are LED light sources or laser light sources.

7. A vehicle headlight, including a headlight body and at least one vehicle light module according to claim 5 mounted in the headlight body; wherein when a plurality of the vehicle light modules are arranged, the plurality of the vehicle light modules are integrally or dispersedly arranged in the headlight body.

8. The vehicle headlight according to claim 7, wherein the light emergent surface of the light emergent portion is of a curved surface structure formed by successively splicing a plurality of convex lens surfaces.

9. The vehicle headlight according to claim 7, wherein a length of a cross section of the light transmission portion in a lateral direction and/or in a longitudinal direction gradually increases from the light incident end to the light emergent end;

the light transmission portion includes a side wall connecting the light incident end with the light emergent end of the light transmission portion;

the side wall is a spliced surface formed by splicing a plurality of side surfaces, and the side surfaces are flat surfaces or curved surfaces; and wherein each of the side surfaces is parallel to a central axis of the light transmission portion or forms an angle with the central axis of the light transmission portion.

10. The vehicle headlight according to claim 9, wherein at least one side surface of the light transmission portion is provided with light eliminating wrinkles and the light eliminating wrinkles are grains or light eliminating teeth.

11. The vehicle headlight according to claim 7, wherein the light sources are LED light sources or laser light sources.

12. The vehicle light module according to claim 5, wherein the light emergent surface of the light emergent portion is of a curved surface structure formed by successively splicing a plurality of convex lens surfaces.

13. The vehicle light module according to claim 5, wherein a length of a cross section of the light transmission portion in a lateral direction and/or in a longitudinal direction gradually increases from the light incident end to the light emergent end;

the light transmission portion includes a side wall connecting the light incident end with the light emergent end of the light transmission portion;

the side wall is a spliced surface formed by splicing a plurality of side surfaces, and the side surfaces are flat surfaces or curved surfaces; and wherein each of the side surfaces is parallel to a central axis of the light transmission portion or forms an angle with the central axis of the light transmission portion.

14. The vehicle light module according to claim 13, wherein at least one side surface of the light transmission portion is provided with light eliminating wrinkles and the light eliminating wrinkles are grains or light eliminating teeth.

* * * * *